US008494422B2

(12) United States Patent
Kang

(10) Patent No.: US 8,494,422 B2
(45) Date of Patent: Jul. 23, 2013

(54) TRANSFER BELT DRIVING CONTROLLER AND ELECTROPHOTOGRAPHIC IMAGE FORMING APPARATUS HAVING THE SAME

(75) Inventor: Kyung-pyo Kang, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 271 days.

(21) Appl. No.: 13/064,441

(22) Filed: Mar. 24, 2011

(65) Prior Publication Data

US 2012/0039640 A1 Feb. 16, 2012

(30) Foreign Application Priority Data

Aug. 16, 2010 (KR) ..... 10-2010-0078857

(51) Int. Cl.
*G03G 15/01* (2006.01)

(52) U.S. Cl.
USPC ..... 399/302

(58) Field of Classification Search
USPC ..... 399/302
See application file for complete search history.

(56) References Cited

U.S. PATENT DOCUMENTS

| | | | | |
|---|---|---|---|---|
| 7,277,667 | B2 * | 10/2007 | Saito et al. | 399/301 |
| 7,569,808 | B2 * | 8/2009 | Yoshioka | 250/231.14 |
| 8,219,003 | B2 * | 7/2012 | Kudo et al. | 399/167 |
| 2003/0076405 | A1 * | 4/2003 | Sanchez et al. | 347/262 |
| 2005/0105937 | A1 * | 5/2005 | Sakai | 399/301 |
| 2007/0096018 | A1 * | 5/2007 | Yoshioka | 250/231.13 |
| 2009/0003864 | A1 * | 1/2009 | Yamaguchi et al. | 399/66 |
| 2009/0169225 | A1 * | 7/2009 | Murata et al. | 399/46 |
| 2010/0017019 | A1 | 1/2010 | Andoh et al. | |

FOREIGN PATENT DOCUMENTS

| | | |
|---|---|---|
| EP | 2009506 A2 | 12/2008 |
| JP | 2004-123383 | 4/2004 |

OTHER PUBLICATIONS

European Search Report dated Dec. 14, 2012 issued in corresponding European Patent Application No. 11163900.1.

* cited by examiner

*Primary Examiner* — G. M. Hyder
(74) *Attorney, Agent, or Firm* — Staas & Halsey LLP

(57) ABSTRACT

A transfer belt driving controller includes an idle roller that is installed on a rotating shaft of one of a plurality of supporting rollers in such a way that the idle roller may freely rotate, and is wrapped and rotated by a transfer belt, where the plurality of supporting rollers are arranged in the transfer belt and to be a predetermined distance apart from each other; an encoder wheel that rotates with the idle roller; an encoder that detects information regarding rotation of the encoder wheel; and a control unit that controls a linear velocity of the transfer belt by feedback controlling a driving source for driving the supporting rollers based on the information regarding rotation of the encoder wheel detected by the encoder.

20 Claims, 6 Drawing Sheets

TRANSFER BELT DRIVING CONTROLLER AND ELECTROPHOTOGRAPHIC IMAGE FORMING APPARATUS HAVING THE SAME

CROSS-REFERENCE TO RELATED APPLICATIONS

This application claims the benefit of Korean Patent Application No. 10-2010-0078857, filed on Aug. 16, 2010, in the Korean Intellectual Property Office, the disclosure of which is incorporated herein in its entirety by reference.

BACKGROUND

1. Field

The present general inventive concept relates to a transfer belt driving controller and an electrophotographic image forming apparatus having the same, and more particularly, to a transfer belt driving controller that detects a speed of a transfer belt and feeds back information to a driving motor based on a result of the detection to control constant velocity drive of the transfer belt, and an electrophotographic image forming apparatus having the same.

2. Description of the Related Art

An electrophotographic image forming apparatus is an apparatus for forming a desired image by receiving digital image signals corresponding to the desired image, forming an electrostatic latent image on a photo conductor by using an exposer, such as a laser scanning unit (LSU), developing the electrostatic latent image into a toner image by using a toner, transferring the toner image to a printing medium, and fusing the toner image to the printing medium by applying heat and pressure to the toner image.

A single-pass type color image forming apparatus generally includes four photoconductive drums, four exposers that form electrostatic latent images on the four photoconductive drums, and four developers that develop the electrostatic latent images formed on the four photoconductive drums by respectively supplying black (K), cyan (C), magenta (M), and yellow (Y) toners thereto. The four photoconductive drums contact an intermediate transfer belt. A color toner image is formed by reiteratively transferring the black (K), cyan (C), magenta (M), and yellow (Y) toner images developed on the four photoconductive drums to the intermediate transfer belt. A desired color image is printed by transferring and fixing the color toner image to a printing medium.

In a color image forming apparatus, since an image is temporarily formed on a surface of a transfer belt before the image is transferred to a printing medium, change of a linear velocity of a transfer belt is an important factor directly affecting quality of a printed image. A linear velocity of a transfer belt is changed by a driving power transmission component for transmitting a driving power from a driving source to a driving roller. As stated above, although precision of the final gear connected to a driving roller for transmitting driving power to a transfer belt and irregular loads of photoconductive drums connected to the transfer belt cause change of a linear velocity of the transfer belt and directly affect quality of an image, it is very difficult to maintain satisfactory precision of related parts.

Therefore, it is necessary to prevent color mis-registration by minimizing change of a linear velocity by accurately detecting change of a linear velocity of a transfer belt and feeding back information to a driving motor based on a result of the detection.

SUMMARY

The present general inventive concept provides a transfer belt driving controller for maintaining image quality by minimizing change of a linear velocity by accurately detecting change of a linear velocity of a transfer belt and feeding back information to a driving motor based on a result of the detection and an electrophotographic image forming apparatus having the transfer belt driving controller.

According to an aspect of the present general inventive concept, there is provided a transfer belt driving controller including an idle roller that is installed on a rotating shaft of one of a plurality of supporting rollers in such a way that the idle roller may freely rotate, and is wrapped and rotated by a transfer belt, where the plurality of supporting rollers are arranged in the transfer belt and to be a predetermined distance apart from each other; an encoder wheel that rotates with the idle roller; an encoder that detects information regarding rotation of the encoder wheel; and a control unit that controls a linear velocity of the transfer belt by feedback controlling a driving source for driving the supporting rollers based on the information regarding rotation of the encoder wheel detected by the encoder.

According to another aspect of the present general inventive concept, there is provided an electrophotographic image forming apparatus including a plurality of photoconductors, on which toner images of different colors are respectively formed; a transfer belt, on which a color image is formed as the toner images of different colors are stacked thereon as the transfer belt rotates and contacts the plurality of photoconductors; a transfer belt driving controller including an idle roller that is installed on a rotating shaft of one of a plurality of supporting rollers in such a way that the idle roller may freely rotate, and is wrapped and rotated by the transfer belt, where the plurality of supporting rollers are arranged in the transfer belt and to be a predetermined distance apart from each other; an encoder wheel that rotates with the idle roller; an encoder that detects information regarding rotation of the encoder wheel; and a control unit that controls a linear velocity of the transfer belt by feedback controlling a driving source for driving the supporting rollers based on the information regarding rotation of the encoder wheel detected by the encoder; and a fixing unit that melt-fixes the color image on a printing medium.

BRIEF DESCRIPTION OF THE DRAWINGS

The above and other features and advantages of the present general inventive concept will become more apparent by describing in detail exemplary embodiments thereof with reference to the attached drawings in which.

DETAILED DESCRIPTION

Figure 1:
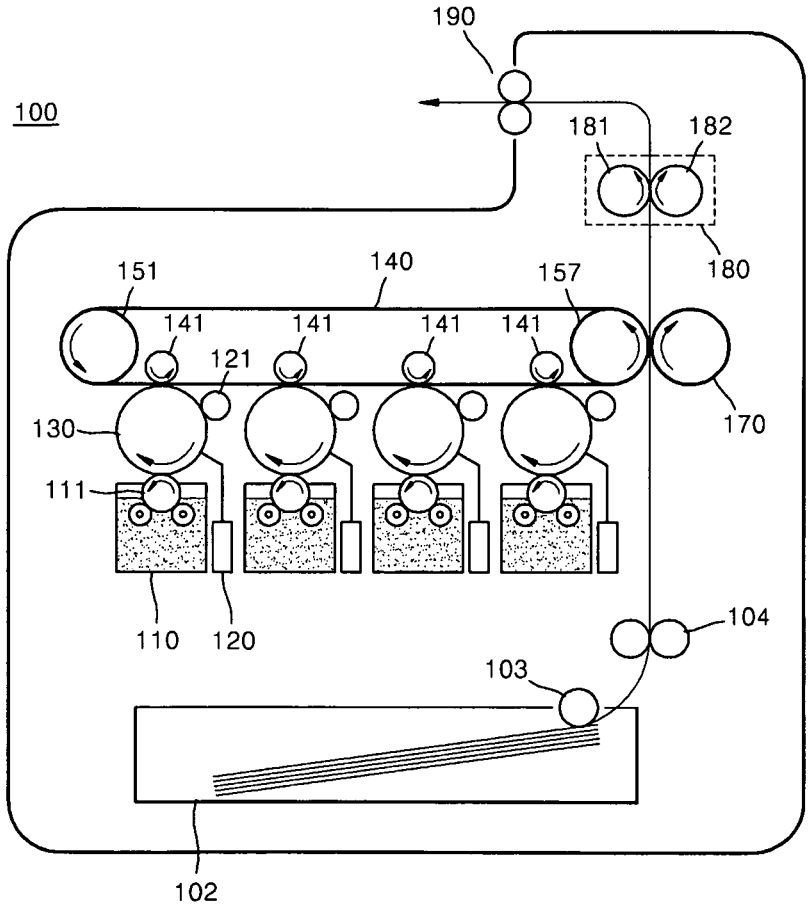
FIG. 1 is a diagram showing the configuration of an image forming apparatus according to an embodiment of the present general inventive concept.

FIG. 1 is a diagram showing the configuration of an image forming apparatus 100 according to an embodiment of the present general inventive concept.

First, referring to FIG. 1, the image forming apparatus 100 includes a printing medium transfer unit, a developing unit 110, an exposure unit 120, a photoconductor 130, a transfer belt 140, and a fixing unit 180.

The printing medium transfer unit is a unit for housing a printing medium to which an image is finally formed and transferring the printing medium along a printing medium transfer path, and includes a cassette 102 that houses a plurality of recording media, a pickup roller 103 that rotates above the cassette 102 and picks up a printing medium, and a transfer roller 104 that transfers a printing medium picked up by the pickup roller 103 to an area at which a color image is transferred.

The developing unit 110 is a unit for developing an electrostatic latent image formed on the photoconductor 130 into a toner image, and includes a developing roller 111 that contacts the photoconductor 130 and rotates to form a toner image. According to the present general inventive concept, four developing units 110 for supplying toners corresponding to colors including magenta, yellow, cyan, and black are employed to form a color image.

The exposure unit 120 exposes portions of an outer surface of the photoconductor 130 that is uniformly charged by a charging roller 121 to a predetermined potential, according to signal of an image to be formed. Therefore, potentials of the portions of the outer surface of the photoconductor 130 exposed by the exposure unit 120 are changed and an electrostatic latent image is formed.

The photoconductor 130 is a unit on which an electrostatic latent image is formed on the outer surface thereof, and may be formed of an organic photoconductor (OPC), for example. According to the present general inventive concept, four photoconductors 130 respectively corresponding to colors including magenta, yellow, cyan, and black are installed in a direction in which the transfer belt 140 rotates. The photoconductors 130 may be installed in any order. Although not shown in FIG. 1, cleaning blades for removing toners attached on outer surfaces of the photoconductors 130 may be further arranged.

The transfer belt 140 is a thin continuous belt that is supported by a driving roller 151 and a driven roller 157, rotates thereon, and has a thickness of about 100 μm. Toner images of each of colors including magenta, yellow, cyan, and black, transferred from the plurality of photoconductors 130, are overlapped on the transfer belt 140 and a color image is formed. A plurality of primary transfer rollers 141 respectively contact the plurality of photoconductors 130 to support the transfer belt 140 between the photoconductors 130 and the primary transfer rollers 141, and are installed on an inner side of the transfer belt 140. A secondary transfer roller 170 contacts the driven roller 157 to support the transfer belt 140 between the driven roller 157 and the secondary transfer roller 170 and transfers a color image formed on the transfer belt 140 to a printing medium, and is installed on an outer side of the transfer belt 140. Although not shown in FIG. 1, a cleaning unit for removing toners attached on the transfer belt 140 may be further arranged. The cleaning unit may also collect toners remaining on the transfer belt 140 after secondary transfer of toner images formed on the transfer belt 140 to the printing medium. For example, the cleaning unit may include cleaning blades configured to contact the outer surfaces of the transfer belt 140 and peel off thin layers of remaining toners from the transfer belt 140. Furthermore, a discharging lamp (not shown) for resetting potentials of the photoconductors 130 may be arranged between the cleaning unit and the charging roller 121 around the photoconductors 130.

The fixing unit 180 fixes a toner image secondarily transferred from the transfer belt, 140 to a printing medium, to the printing medium. The fixing unit 180 includes a heating roller 181 and a pressing roller 182. The heating roller 181 is a cylindrical member that may rotate along its shaft, and a heat source, e.g., a halogen lamp (not shown), is installed therein. The pressing roller 182 is a cylindrical member that may rotate along its shaft, and is installed to press the heating roller 181. Heat-resistant elastic layers may be installed on outer surfaces of the heating roller 181 and the pressing roller 182. A toner image is melt-fixed to a printing medium by transferring the printing medium through a fixing nib at which the heating roller 181 and the pressing roller 182 correspond to each other.

Furthermore, the image forming apparatus 100 includes an exiting roller 190 for discharging a printing medium to which a toner image is fixed by the fixing unit 180, out of the image forming apparatus 100.

Operations of an image forming apparatus configured as stated above will be described below.

When the image forming apparatus 100 operates, image signals of an image to be printed are transmitted to a control unit (not shown). Next, the control unit uniformly charges the outer surface of the photoconductor 130 to a predetermined potential by using the charging roller 121 based on the received image signals and forms an electrostatic latent image by irradiating a laser to the outer surface of the photoconductor 130 by using the exposure unit 120.

Meanwhile, the developing unit 110 sufficiently charges a toner and attaches the toner to the developing roller 111. Next, when the toner is transferred to an area facing the photoconductor 130 by rotation of the developing roller 111, the toner attached to the developing roller 111 moves to the electrostatic image formed on the outer surface of the photoconductor 130 and forms a toner image. The toner image is primarily transferred from the photoconductor 130 to the transfer belt 140 at an area at which the photoconductor 130 and the transfer belt 140 face each other. Toner images formed on the four photoconductors 130 are sequentially stacked on each other on the transfer belt 140, and thus a single stacked color image is formed. Next, the color image is secondarily transferred to a printing medium transferred by the printing medium transferring unit in an area at which the driven roller 157 and the secondary transfer roller 170 correspond to each other. The color image is melt-fixed to the printing medium by transferring the printing medium through between the heating roller 181 and pressing roller 182 to apply heat and pressure. Next, the printing medium is discharged out of the image forming apparatus 100 by the exciting roller 190. Meanwhile, in the case where a cleaning unit is arranged, toners remaining on the transfer belt 140 may be removed by the cleaning unit after the color image is secondarily transferred to the printing medium.

Next, referring to FIGS. 2 through 4, a configuration and operations of a transfer belt driving controller according to the present general inventive concept will be described.

Figure 2:
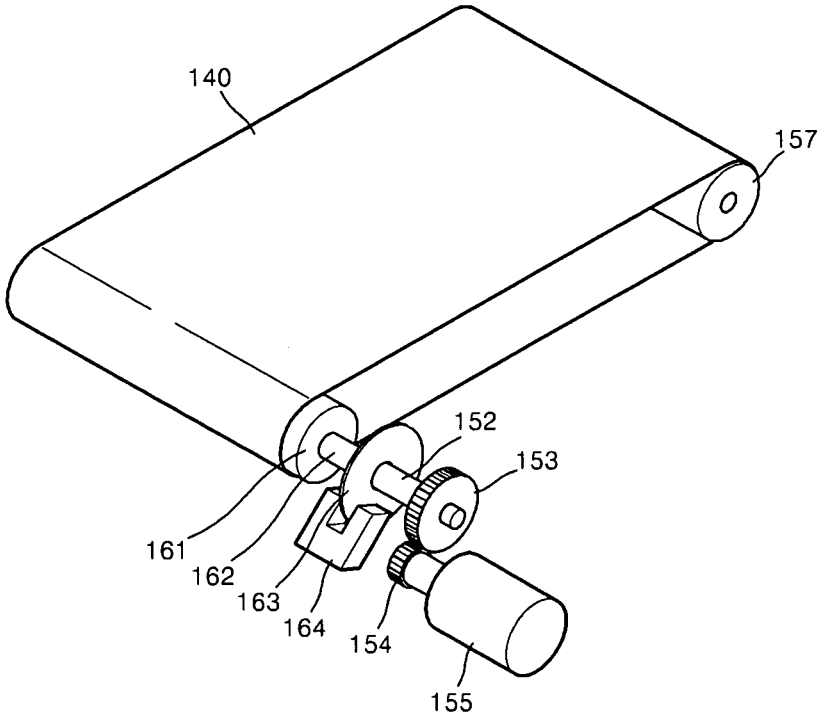
FIG. 2 is a perspective view showing a configuration of a transfer belt driving controller according to the present general inventive concept.

FIG. 2 is a perspective view showing a configuration of a transfer belt 160 driving controller according to the present general inventive concept. FIG. 3 is a side view of the transfer belt driving controller 160. FIG. 4 is a side view for describing a relationship between an idle roller and a rotation shaft.

Change in a linear velocity of a transfer belt greatly affects quality of an image to be printed. A linear velocity of a transfer belt is usually changed by a driving power transmission component for transmitting a driving power from a driving source to a driving roller. Precision of a final gear connected to a driving roller for transmitting driving power to a transfer belt and irregular loads of photoconductive drums connected to the transfer belt cause change of a linear velocity of the transfer belt and directly affect quality of an image.

Figure 3:
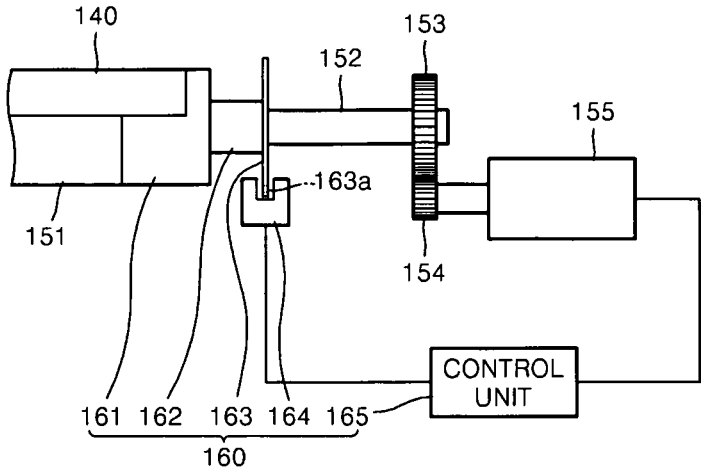
FIG. 3 is a side view of the transfer belt driving controller.
Figure 4:
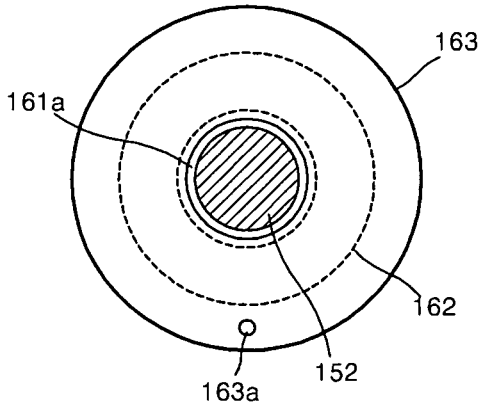
FIG. 4 is a side view for describing a relationship between an idle roller and a rotation shaft.

Referring to FIGS. 2 through 4, the transfer belt driving controller 160 is a device for maintaining registration of a color image formed on the transfer belt 140 by reducing change of a linear velocity of the transfer belt 140 and keeping the linear velocity of the transfer belt 140 constant, and includes an idle roller 161, an encoder wheel 163, an encoder 164, and a control unit 165.

The idle roller 161 is installed on a rotating shaft 152 of the supporting roller 151, in such a way that the idle roller 161 may freely rotate. Here, a via hole 161*a* is formed in the idle roller 161, and the idle roller 161 is installed in such a way that the rotation shaft 152 of the supporting roller 151 penetrates the via hole 161*a*. Here, a diameter of the via hole 161*a* of the idle roller 161 is formed to be larger than a diameter of the rotation shaft 152 of the supporting roller 151, so that rotation of the rotation shaft 152 does not significantly affect the idle roller 161. Here, a lubricant may be added or a bearing (ball bearing) may be installed between the via hole 161*a* and the rotation shaft 152 for slip therebetween.

The idle roller 161 is installed in such a way that an end of the idle roller 161 contacts an end of the supporting roller 151 and a portion of an outer surface of the idle roller 161 is surrounded by the transfer belt 140. Therefore, when the transfer belt 140 rotates, the idle roller 161 is also rotated by friction force. In other words, though an end of the idle roller 161 contacts an end of the supporting roller 151, the idle roller 161 is rotated mainly by the rotation force of the transfer belt 140.

A condition in which there is no slip between the transfer belt 140 and the supporting roller 151 or the idle roller 161 may be optimized by using the Eytelwein equation shown below.

$$\frac{T_t - \overline{m}v^2}{T_s - \overline{m}v^2} = e^{\mu\theta}$$

Here, Tt indicates tight side tension, Ts indicates slack side tension, V indicates velocity of the transfer belt 140 (if the value of V is above 10 m/s, centrifugal force with respect to a mass of the transfer belt 140 shall be considered), m indicates the mass of the transfer belt 140 per unit length, e indicates a wrap angle at which a circular arc of the transfer belt 140 wraps around a supporting roller 151 with respect to a center of the supporting roller 151 (the unit is in [rad]), μ indicates a friction coefficient, $mv^2$ indicates centrifugal force per unit length formed by the mass of the transfer belt 140 (also referred to as centrifugal tension or additional tension), and the value of e is 2.718.

According to the Equation above, the slipping condition is proportional to the wrap angle at a velocity at which centrifugal force may be neglected. If it is assumed that the friction coefficient is 0.8, the value of $e^{\mu e}$ is 1 when the wrap angle is 0 degree, the value of $e^{\mu e}$ is 3.514 when the wrap angle is 90 degree, and the value of $e^{\mu e}$ is 12.345 when the wrap angle is 180 degree. Therefore, it is clear that rotation force increases as the wrap angle increases.

Therefore, the supporting rollers 151 and 157 for supporting the transfer belt 140 have the same diameter, and the supporting rollers 151 and 157 contact the transfer belt 140 at any wrap angle up to 180 degree. Furthermore, a diameter of the idle roller 161 and the diameter of the supporting roller 151 are the same.

If slip between the transfer belt 140 and the idle roller 161 is neglected, the linear velocity of the transfer belt 140 may be identical to an angular velocity of the idle roller 161. In other words, the linear velocity of the transfer belt 140 may be detected by detecting the angular velocity of the idle roller 161, and thus changes of the linear velocity may be detected.

The idle roller 161 may be installed to one of the plurality of supporting rollers 151 and 157, where one of the plurality of supporting rollers 151 and 157 may be a driving roller for receiving driving power from a driving source 155 via gearing of transmission gears 153 and 154, and the other one of the plurality of supporting rollers 151 and 157 may be a driven roller wrapped and rotated by the transfer belt 140.

The encoder wheel 163 is formed as a single body with the idle roller 161 by a connecting unit 162. Therefore, when the idle roller 161 rotates, the encoder wheel 163 also rotates, and thus an angular velocity of the encoder wheel 163 is identical to the angular velocity of the idle roller 161. The via hole 161*a* shown in FIG. 4 is formed to penetrate through the idle roller 161, the connecting unit 162, and the encoder wheel 163.

The encoder 164 detects the angular velocity of the encoder wheel 163. Although not shown, the encoder 164 includes a light emitting unit and a light receiving unit and detects the angular velocity of the encoder wheel 163 rotating between the light emitting unit and the light receiving unit. Here, a hole 163*a* through which light may pass is formed in the encoder wheel 164.

The encoder wheel 163 and the encoder 164 are units for detecting the angular velocity of the idle roller 161. As long as the angular velocity of the idle roller 161 may be detected, the present general inventive concept is not limited to the encoder wheel 163 and the encoder 164 as shown in FIG. 4, and any of various modifications may be made therein.

The controller 165 controls the linear velocity of the transfer belt 140 wrapping the supporting roller 151 by feeding back information to the driving source 155 based on information regarding rotation of the encoder wheel 163 detected by the encoder 164 and controlling speed of rotation of the supporting roller 151.

Figure 5:
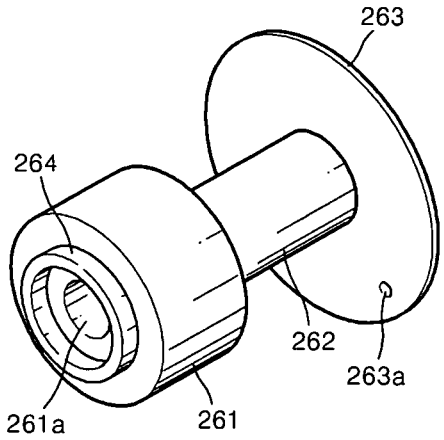
FIG. 5 is a perspective view of an idle roller according to another embodiment of the present general inventive concept.
Figure 6:
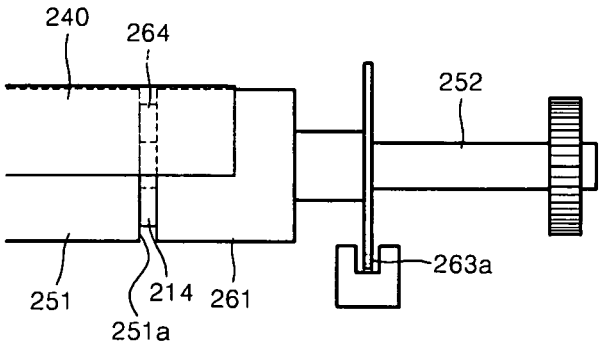
FIG. 6 is a diagram for describing a relationship between the idle roller shown in FIG. 5 and a driving roller.

FIG. 5 is a perspective view of an idle roller according to another embodiment of the present general inventive concept, and FIG. 6 is a diagram for describing a relationship between the idle roller shown in FIG. 5 and a driving roller.

Referring to FIGS. 5 and 6, an idle roller 261 and an encoder wheel 263 are formed as a single body by a connecting unit 262, and a via hole 261*a* is formed to penetrate through the idle roller 261, the connecting unit 262, and the encoder wheel 263. A circular protrusion 264 is formed on a surface of the idle roller 261 facing a supporting roller 251 around the via hole 261. The via hole 261 a is formed to have a diameter greater than a diameter of a rotation shaft 252. A hole 263*a*, via which light of the encoder (164 of FIG. 2) may pass through, is formed in the encoder wheel 263*a*.

When the idle roller 261 is installed by inserting the rotation shaft 252 of the supporting roller 251 through the idle roller 261, the protrusion 264 contacts a surface 251*a* of the supporting roller 251. The transfer belt 204 is installed to partially surround the supporting roller 251 and the idle roller 261.

By forming the protrusion 264 on a surface of the idle roller 261, an area at which the idle roller 261 and the supporting roller 251 contact each other is reduced, and thus the idle roller 261 is not affected by rotation of the supporting roller 251. Furthermore, since the idle roller 261 is not affected by rotation of the rotation shaft 252, the idle roller 261 may only be rotated by rotation of the transfer belt 240. Shapes of the protrusion 264 are not limited to the shape shown in FIGS. 5 and 6, and any of various modification may be made therein to reduce an area at which the idle roller 261 and the supporting roller 251 contact each other. For example, a plurality of protrusions may be formed around the via hole 261*a*.

Figure 7:
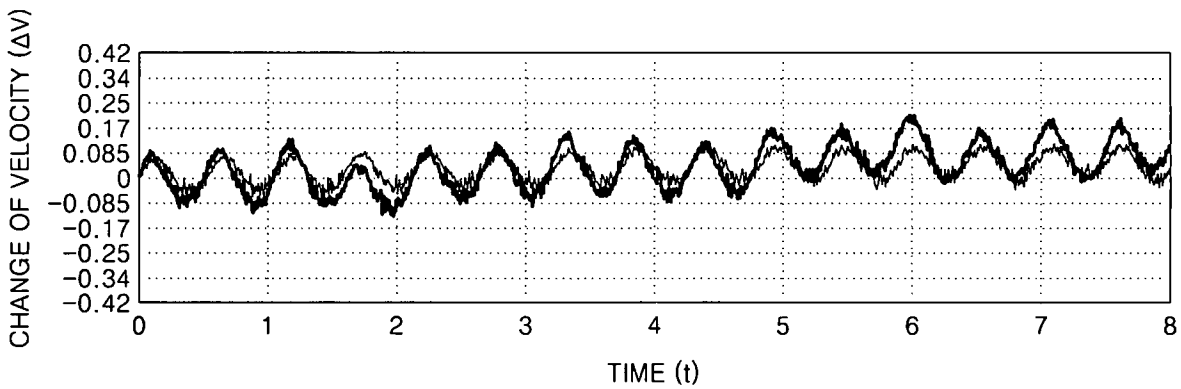
FIG. 7 is a graph for describing velocity control of a transfer belt driving controller according to the present general inventive concept.
Figure 8:
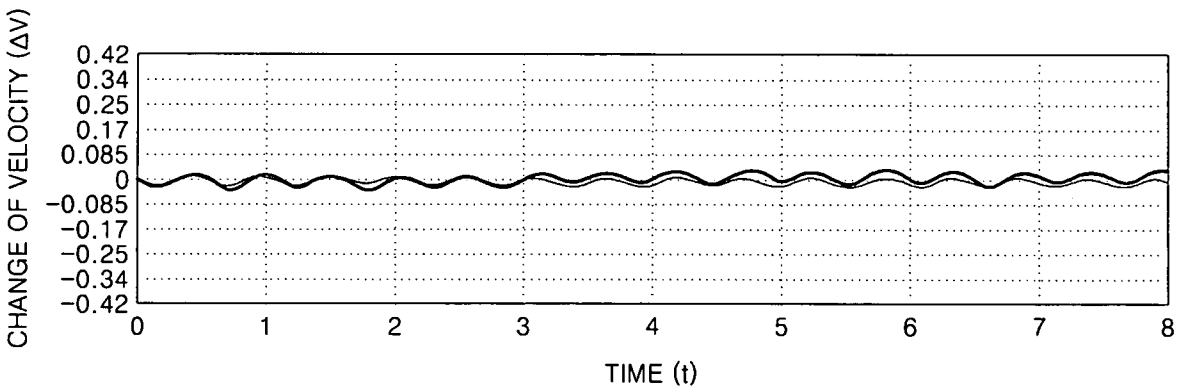
FIG. 8 is a graph showing a result fed back by a transfer belt driving controller according to the present general inventive concept.

FIG. 7 is a graph for describing velocity control of a transfer belt driving controller according to the present general inventive concept, and FIG. 8 is a graph showing a result fed back by a transfer belt driving controller according to the present general inventive concept.

Referring to FIG. 7, a plot indicated by a thick solid line indicates changes of velocity of a transfer belt according to lapse of time, detected by using a laser Doppler velocimeter (LDV), whereas a plot indicated by a thin solid line indicates changes of velocity of an encoder wheel according to lapse of time, detected by using an encoder.

Comparing the two plots, although there are slight differences in some sections due to slip between transfer belts and idle rollers, the two graphs are overall similar to each other. Therefore, change of the velocity of the encoder wheel according to the present general inventive concept precisely reflects change of the velocity of the transfer belt.

Referring to FIG. 8, a plot indicated by a thick solid line indicates changes of velocity of a transfer belt according to lapse of time, detected by using a LDV, whereas a plot indicated by a thin solid line indicates changes of velocity of an encoder wheel according to lapse of time, detected by using an encoder.

Comparing the two plots, as a result of feedback, the velocity changes less as compared to FIG. 7. Furthermore, although there are slight differences, the two graphs are overall similar to each other. Therefore, a transfer belt driving controller according to the present general inventive concept precisely reflects change of a linear velocity of a transfer belt and precisely controls the linear velocity of the transfer belt during feedback control.

Although a few embodiments have been shown and described, it would be appreciated by those skilled in the art that changes may be made in these embodiments without departing from the principles and spirit of the invention, the scope of which is defined in the claims and their equivalents.

What is claimed is:

1. A transfer belt driving controller comprising:

an idle roller that is installed on a rotating shaft of one of a plurality of supporting rollers in such a way that the idle roller may freely rotate, and is wrapped and rotated by a transfer belt, where the plurality of supporting rollers are arranged in the transfer belt and to be a predetermined distance apart from each other;

an encoder wheel that rotates with the idle roller;

an encoder that detects information regarding rotation of the encoder wheel; and a control unit that controls a linear velocity of the transfer belt by feedback controlling a driving source for driving the supporting rollers based on the information regarding rotation of the encoder wheel detected by the encoder.

2. The transfer belt driving controller of claim 1, wherein the idle roller and the encoder wheel are formed as a single body, and a via hole is formed in the idle roller and the encoder wheel in such a way that the rotation shaft may pass therethrough.

3. The transfer belt driving controller of claim 2, wherein a diameter of the via hole is larger than a diameter of the rotation shaft.

4. The transfer belt driving controller of claim 2, wherein a protrusion for reducing an area at which the idle roller and the supporting roller contact each other is arranged on a surface of the idle roller.

5. The transfer belt driving controller of claim 3, wherein a protrusion for reducing an area at which the idle roller and the supporting roller contact each other is arranged on a surface of the idle roller.

6. The transfer belt driving controller of claim 1, wherein diameters of the plurality of supporting rollers are the same.

7. The transfer belt driving controller of claim 6, wherein a protrusion for reducing an area at which the idle roller and the supporting roller contact each other is arranged on a surface of the idle roller.

8. The transfer belt driving controller of claim 1, wherein one of the plurality of supporting rollers is a driving roller for receiving driving power from the driving source, and another one of the plurality of supporting rollers is a driven roller that is wrapped and rotated by the transfer belt.

9. The transfer belt driving controller of claim 8, wherein a protrusion for reducing an area at which the idle roller and the supporting roller contact each other is arranged on a surface of the idle roller.

10. The transfer belt driving controller of claim 1, wherein a protrusion for reducing an area at which the idle roller and the supporting roller contact each other is arranged on a surface of the idle roller.

11. An electrophotographic image forming apparatus comprising:

a plurality of photoconductors, on which toner images of different colors are respectively formed;

a transfer belt, on which a color image is formed as the toner images of different colors are stacked thereon as the transfer belt rotates and contacts the plurality of photoconductors;

a transfer belt driving controller comprising:

an idle roller that is installed on a rotating shaft of one of a plurality of supporting rollers in such a way that the idle roller may freely rotate, and is wrapped and rotated by the transfer belt, where the plurality of supporting rollers are arranged in the transfer belt and to be a predetermined distance apart from each other;

an encoder wheel that rotates with the idle roller;

an encoder that detects information regarding rotation of the encoder wheel; and a control unit that controls a linear velocity of the transfer belt by feedback controlling a driving source for driving the supporting rollers based on the information regarding rotation of the encoder wheel detected by the encoder; and a fixing unit that melt-fixes the color image on a printing medium.

12. The electrophotographic image forming apparatus of claim 11, wherein the idle roller and the encoder wheel are formed as a single body, and a via hole is formed in the idle roller and the encoder wheel in such a way that the rotation shaft may pass therethrough.

13. The electrophotographic image forming apparatus of claim 12, wherein a diameter of the via hole is larger than a diameter of the rotation shaft.

14. The transfer belt driving controller of claim 12, wherein a protrusion for reducing an area at which the idle roller and the supporting roller contact each other is arranged on a surface of the idle roller.

15. The transfer belt driving controller of claim 13, wherein a protrusion for reducing an area at which the idle roller and the supporting roller contact each other is arranged on a surface of the idle roller.

16. The electrophotographic image forming apparatus of claim 11, wherein diameters of the plurality of supporting rollers are the same.

17. The transfer belt driving controller of claim 16, wherein a protrusion for reducing an area at which the idle roller and the supporting roller contact each other is arranged on a surface of the idle roller.

18. The electrophotographic image forming apparatus of claim 11, wherein one of the plurality of supporting rollers is a driving roller for receiving driving power from the driving source, and another one of the plurality of supporting rollers is a driven roller that is wrapped and rotated by the transfer belt.

19. The transfer belt driving controller of claim 18, wherein a protrusion for reducing an area at which the idle roller and the supporting roller contact each other is arranged on a surface of the idle roller.

20. The transfer belt driving controller of claim 11, wherein a protrusion for reducing an area at which the idle roller and the supporting roller contact each other is arranged on a surface of the idle roller.

* * * * *